United States Patent [19]

Weichhand et al.

[11] 4,054,019

[45] Oct. 18, 1977

[54] ARTICULATED TAMPER AND CONFINER

[75] Inventors: Robert J. Weichhand, Fort Mitchell; Charles W. Adams, Walton, both of Ky.

[73] Assignee: R. A. Jones & Co. Inc., Covington, Ky.

[21] Appl. No.: 748,062

[22] Filed: Dec. 6, 1976

[51] Int. Cl.[2] ..... B65B 63/02

[52] U.S. Cl. ..... 53/124 D; 53/252; 100/177; 100/232

[58] Field of Search ..... 53/124 D, 124 A, 252, 53/258; 100/177, 232

[56] References Cited

U.S. PATENT DOCUMENTS 3,821,874 7/1974 Jones ..... 53/252 X 3,879,920 4/1975 Langen ..... 53/252 X

*Primary Examiner*—Travis S. McGehee

*Attorney, Agent, or Firm*—Wood, Herron & Evans

[57] ABSTRACT

In a cartoning machine, a series of L-shaped product buckets mounted on a chain conveyor and a series of inverted L-shaped tamper-confiner elements mounted on a conveyor chain overlying the product buckets, the tamper confiner elements being cammed to form, with the product buckets, a gradually closing, generally rectangular compartment whose inside dimensions are substantially the same as the carton into which the product is to be inserted. One leg of the tamper-confiner element is articulated to engage the bottom wall of the product bucket before the tamper-confiner is in its final position, thereby preventing pinching of the product.

4 Claims, 3 Drawing Figures

ARTICULATED TAMPER AND CONFINER

Figure 1:
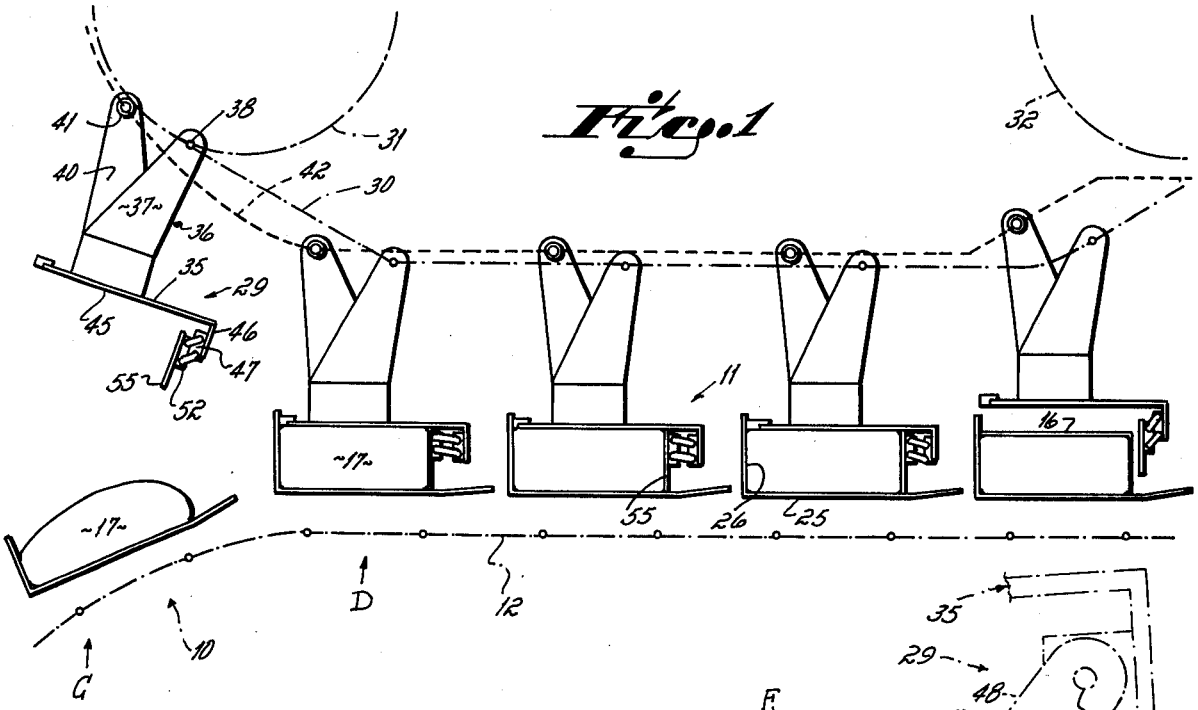

This invention relates to a combination of product bucket and tamper-confiner which together shape a product for insertion into a carton all as disclosed in U.S. Pat. No. 3,932,983. This invention is particularly directed to an improvement in the tamper-confiner which involves the use of an articulated or hinged wall which eliminates pinching of the product between the tamper-confiner and product bucket.

In continuous motion cartoners, it is common practice to convey an erected tubular carton in a horizontal attitude along a carton conveyor which includes spaced transport lugs mounted on chains, the cartons being confined between the transport lugs. Running parallel with the carton conveyor is a product bucket conveyor carrying a series of buckets, each of which is normally U-shaped. A barrel loader, which includes pusher elements carried by an endless chain, gradually thrusts a product from each bucket into a carton running parallel with the product bucket.

In such apparatus, the cartoning of a flexible pouch containing a particulate product has given rise to problems. In order to avoid an accusation of deceptive packaging, it is important that the pouch be fitted as snugly as possible into the carton.

In practice, the U-shaped product bucket has been made wide compared to the product in order to facilitate the transfer of the product into the product bucket. The edge of the product bucket has had its side walls adjacent the carton conveyor tapered inwardly so as to funnel the product into the carton as the pusher element of the barrel loader thrusts it from the product bucket into the carton. The funnel opening must be approximately the same dimension as the carton, and the pusher element must be approximately that dimension in order to push the product past the funnel opening into the carton.

When the flexible pouch is flopped onto the product bucket, it will not assume the precise position and configuration to be driven from the product bucket through the funnel opening into the carton. When there is a bad misalignment, the pouch tends to jam as it goes into the carton. Further, there is a resistance to the positioning of the pusher element created in part by the engagement of the top surface of the pouch by a flat tamper element which presses on the pouch to give it the proper vertical dimension or thickness. That resistance to the pusher element tends to cause the pouch to wrap around the pusher element so that in some instances, after the pouch has been thrust into the carton, the withdrawal of the pusher element will withdraw with it the pouch from the carton.

The invention of U.S. Pat. No. 3,932,983 provides an L-shaped product bucket which is similar to the conventional U-shaped product bucket but has the leading wall removed. The bottom wall of the product bucket may be substantially the full pitch of the machine. The invention further provides an inverted L-shaped tamper-confiner which is carried above the product bucket on an endless chain and is cammed to move gradually into position with respect to the product bucket so as to gradually form with the product bucket a tubular opening of the same dimension as the carton. In gradually moving into this relationship, the tamper-confiner engages and shapes the pouch into a generally rectangular cross-sectional configuration approximating the configuration of the carton into which it is to be inserted.

The tamper-confiner is pivotally supported on the endless chain and has a bracket riding in a cam track. The cam track configuration may be designed to impart any desired movement to the tamper-confiner within limits.

Some pouches present a problem to the tamper-confiner described above in that as the tamper-confiner moves into position with respect to the product bucket to create the generally rectangular cross-sectional configuration, a portion of the pouch confined becomes pinched between the depending wall of the tamper-confiner and the generally horizontal wall of the product bucket. Such a pinched pouch can become damaged as it is thrust from the product bucket.

An objective of the present invention has been to provide a solution to the problem of the pinched pouch. The objective is achieved by hinging a leading wall on the tamper-confiner for generally vertical movement with respect to the product bucket. The articulated wall hangs down from its normal position with respect to the tamper-confiner so that as the tamper-confiner moves into engagement with the product bucket, the articulated wall engages the horizontal wall of the product bucket ahead of its final position. As the product bucket moves forward relative to the tamper-confiner, the articulated wall slides along the bottom wall of the product bucket pushing the product toward the trailing wall of the product bucket until the final position is reached to confine the product in a generally rectangular configuration. The action of sliding along the product bucket avoids the pinching of the product which may occur when the rigid vertical element of the tamper-confiner moves downwardly into its final position with respect to the product bucket.

Figure 2:
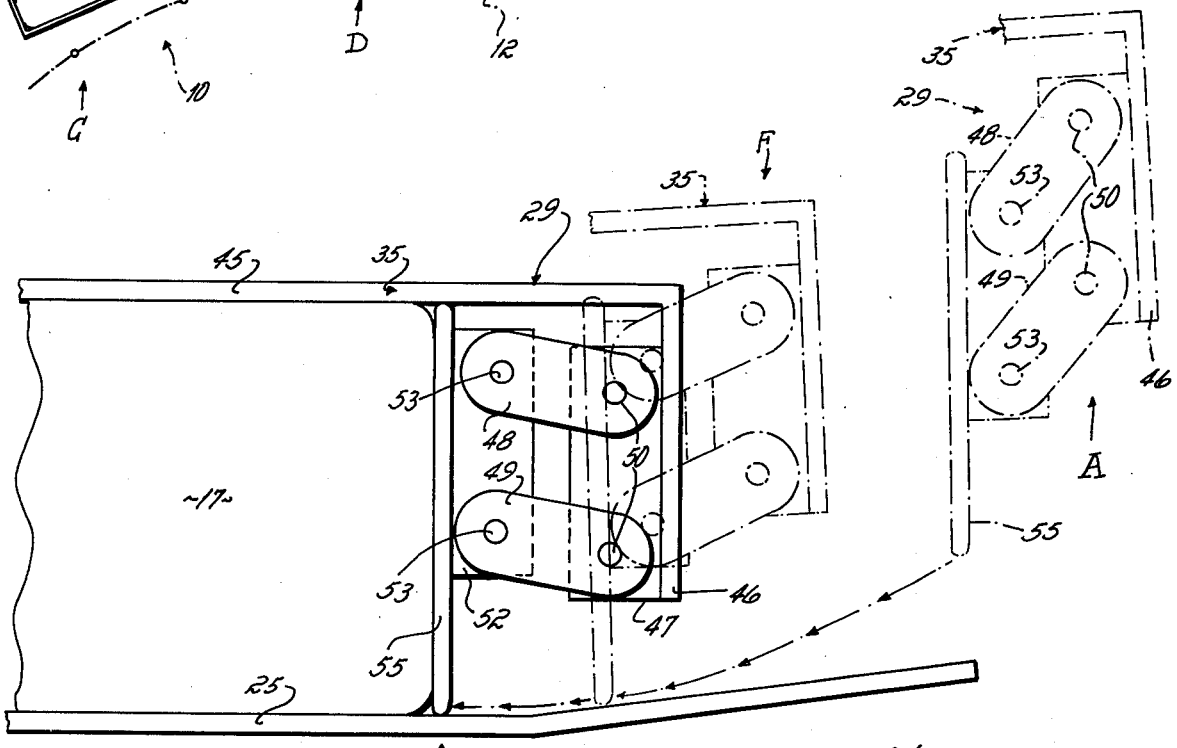
Figure 3:
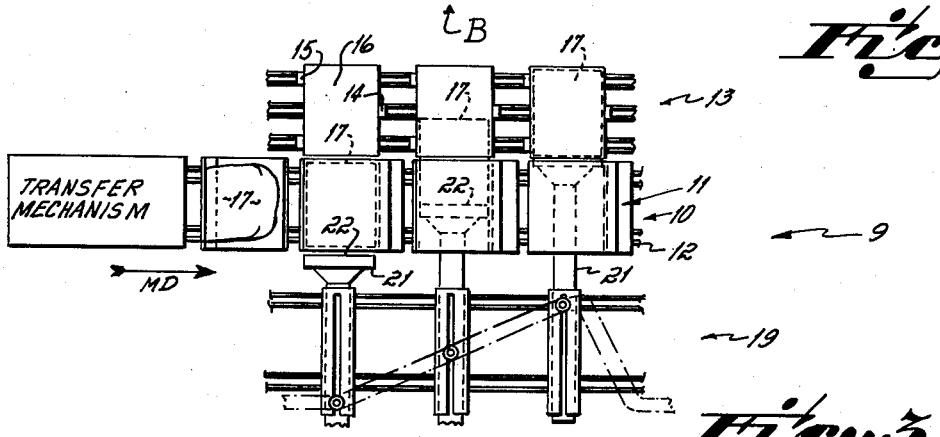

The several features of the present invention will become more readily apparent from the following detailed description taken in conjunction with the accompanying drawings in which FIG. 1 is a diagrammatic side elevational view of the invention;

FIG. 2 is a diagrammatic side elevational view illustrating the sequence of positions of the tamper-confiner with respect to the product bucket as the two elements move together; and FIG. 3 is a diagrammatic top plan view of the invention and associated cartoner elements with which it cooperates.

The cartoner employing product buckets conveyed parallel to a carton conveyor and a barrel loader for thrusting a product from the product buckets into cartons is conventional and will not be illustrated in detail here.

Referring to FIG. 3, a cartoner 9 includes a product bucket conveyor 10 comprising product buckets 11 supported on endless chains 12. A carton conveyor 13 has a leading transport lug 14 and trailing transport lugs 15 which confine between them the cartons 16 into which a product is to be loaded.

The product, which in this instance consists of a flexible pouch 17, is discharged one at a time into a respective product bucket 11. The product is conveyed in the product bucket past a barrel loader 19 having a plurality of conventional pusher elements 21. The end faces 22 of the pusher elements 21 are of the same rectangular dimension as the inside of the carton. The pusher elements are endlessly driven and cammed to move gradually through a product bucket 11 to drive the product in the bucket from the bucket into the adjacent carton 16.

Referring to FIG. 1, each product bucket 11 is L-shaped and has a horizontal bottom wall 25 whose length may be up to the pitch of the machine, the pitch being the distance between centers of adjacent buckets or cartons. The product bucket 11 also has a trailing vertical wall 26. A series of product buckets 11 is mounted on one or more endless chains 12 in spaced relation, as illustrated.

Overlying the product bucket conveyor 10 is a tamper-confiner 29. The tamper-confiner 29 includes an endless chain 30 passing aroung sprockets 31 and 32. A series of L-shaped tamper-confiner elements 35 are fixed on brackets 36. Each bracket 36 has a chain arm 37 by which it is connected to the chain 30 about a pivot axis 38. The bracket 36 also includes a cam arm 40 carrying a roller 41 which rides in an endless cam track 42. The configuration of the cam track determines, to some extent, the path of movement which each tamper-confiner element 35 takes.

The tamper-confiner element 35 is of a generally inverted L-shape having a horizontal top wall 45 and a depending leading wall 46. The leading wall 46 has a hinge block 47 fixed to it. The hinge block carries on each side two links 48 and 49 which are pivoted at 50 to the block 47. The other ends of the links 48 and 49 are pivoted to a hinge block 52 at pivot points 53. A nylon plate 55 is fixed to the hinge block 52 and is adapted to swing from a downwardly depending position shown at (A) when it is out of engagement with the product bucket to a final position shown at (B) when it is in its final position in engagement with the product bucket. There, the plate 55, cooperating with the top wall 45 of the tamper-confiner and the product bucket, confines the product 17 in a generally rectangular configuration from which it is thrust by the pusher elements 21 of the carton into the cartons 16.

The sequence of operations illustrated in FIG. 2 occurs as product bucket 11 and tamper-confiner 35 move toward each other from the position shown at (C) at the left side of FIG. 1 to the positions shown at (D) in the left side of FIG. 1. As the tamper-confiner moves downwardly from its position (A) in FIG. 2, the product bucket moves forward relative to the tamper-confiner to bring the two elements together. At some point, intermediate the positions illustrated at (A) and (B) and shown at the position (F), the lower end of the nylon plate 55 engages the bottom wall 25 of the product bucket. At this point, the product 17 which has been flopped loosely into the corner of the product bucket is in such a position that it cannot be pinched between the plate 55 and the product bucket bottom wall 25.

Continued movement of the elements together causes the nylon plate to slide along the product bucket bottom wall 25 to compress the pouch 17 into its final generally rectangular configuration, again without pinching any portion of the wall of the pouch.

When the product is in its final configuration, it is thrust by the barrel loader 19 of the cartoner into a carton 16.

We claim:

1. In a cartoner, a product bucket comprising a lower L-shaped element having a horizontal wall and a trailing vertical wall for supporting a product, a tamper-confiner comprising an upper L-shaped element having a horizontal wall and a leading vertical wall for forming a generally rectangular tube to tamp and confine a product between said two elements, and means for moving said upper element downwardly and rearwardly with respect to said lower element to form said tube, the improvement comprising:

a generally vertical movable element, means hinging said element to said leading vertical wall, said element engaging said horizontal wall of said lower element and sliding on said wall toward said trailing vertical wall as said upper element moves downwardly and rearwardly relative to said lower element.

2. Apparatus as in claim 1 in which said hinging means comprises:

an inwardly facing block on said leading wall, an outwardly facing block on said movable element, and upper and lower parallel links pivoted respectively to said blocks.

3. Apparatus as in claim 1 in which said horizontal wall of said lower element has an upwardly inclined leading portion.

4. In a cartoner comprising an L-shaped product bucket having a horizontal wall and a trailing vertical wall, a tamper-confiner overlying said product bucket and having an upper horizontal wall, and means for moving said tamper-confiner relative to said product bucket to engage a product in said bucket, the improvement comprising:

a vertical plate, a vertical member depending from said upper horizontal wall, means hinging said vertical plate to said vertical member for vertical movement relative to said upper horizontal wall, whereby when said tamper-confiner moves relatively toward said product bucket, said hinged vertical plate first engages said bucket horizontal wall and then slides toward said product finally enclosing the product in a generally rectangular tube formed by said product bucket and tamper-confiner, respectively.

* * * * *